US011191417B2

(12) United States Patent
Haegermarck

(10) Patent No.: US 11,191,417 B2
(45) Date of Patent: Dec. 7, 2021

(54) WASH ARM ASSEMBLY

(71) Applicant: ELECTROLUX APPLIANCES AKTIEBOLAG, Stockholm (SE)

(72) Inventor: Anders Haegermarck, Trångsund (SE)

(73) Assignee: Electrolux Appliances Aktiebolag

( * ) Notice: Subject to any disclaimer, the term of this patent is extended or adjusted under 35 U.S.C. 154(b) by 67 days.

(21) Appl. No.: 16/314,777

(22) PCT Filed: Jul. 8, 2016

(86) PCT No.: PCT/EP2016/066288
§ 371 (c)(1),
(2) Date: Jan. 2, 2019

(87) PCT Pub. No.: WO2018/006975
PCT Pub. Date: Jan. 11, 2018

(65) Prior Publication Data

US 2019/0307308 A1 Oct. 10, 2019

(51) Int. Cl.
*A47L 15/23* (2006.01)
*A47L 15/42* (2006.01)

(52) U.S. Cl.
CPC ..... *A47L 15/23* (2013.01); *A47L 15/4217* (2013.01); *A47L 15/4219* (2013.01)

(58) Field of Classification Search
CPC ..... A47L 15/00–508
See application file for complete search history.

(56) References Cited

U.S. PATENT DOCUMENTS 2,637,595 A 5/1953 Fox et al.
3,342,421 A 9/1967 Schutte
3,468,485 A 9/1969 Sully
(Continued)

FOREIGN PATENT DOCUMENTS

AT 251239 12/1966
CH 406549 A 1/1966
(Continued)

OTHER PUBLICATIONS

International Search Report and Written Opinion for Application No. PCT/CN2016/103991 dated Mar. 7, 2017, 9 pages.
(Continued)

*Primary Examiner* — Michael E Barr
*Assistant Examiner* — Omair Chaudhri
(74) *Attorney, Agent, or Firm* — RatnerPrestia

(57) ABSTRACT

A wash arm assembly may include wash arm having a tubular connection portion and a tubular receiving means for receiving the tubular connection portion. The tubular connection portion may include a first guiding surface and a second guiding surface, and the tubular receiving means may include a third guiding surface and a fourth guiding surface. The first guiding surface may be aligned to the third guiding surface and the second guiding surface may be aligned to the fourth guiding surface when the tubular connection portion is inserted in the tubular receiving means. The first, second, third and fourth guiding surfaces may be arranged to guide the tubular connection portion and the tubular receiving means into alignment with each other upon rotation of the wash arm. A dishwasher including the wash arm assembly may also be provided.

18 Claims, 3 Drawing Sheets

(56) References Cited

U.S. PATENT DOCUMENTS

| | | | | |
|---|---|---|---|---|
| 3,677,473 | A | 7/1972 | Belaieff | |
| 4,301,822 | A | 11/1981 | Dingler | |
| 5,211,190 | A * | 5/1993 | Johnson | A47L 15/23 134/180 |
| 5,477,874 | A | 12/1995 | Yura et al. | |
| 5,542,443 | A | 8/1996 | Yura et al. | |
| 5,752,533 | A | 5/1998 | Edwards | |
| 5,904,166 | A | 5/1999 | Naunt et al. | |
| 6,959,881 | B2 * | 11/2005 | Kim | A47L 15/23 134/176 |
| 7,753,062 | B2 | 7/2010 | Burrows et al. | |
| 7,931,034 | B2 | 4/2011 | Mack et al. | |
| 8,939,162 | B2 | 1/2015 | Winkler et al. | |
| 9,010,345 | B2 | 4/2015 | Mitchell et al. | |
| 9,427,132 | B2 | 8/2016 | Boyer et al. | |
| 9,456,730 | B2 | 10/2016 | Bayer et al. | |
| 9,462,924 | B2 | 10/2016 | Pyo et al. | |
| 9,462,927 | B2 | 10/2016 | Lee et al. | |
| 2009/0255560 | A1 | 10/2009 | Lehmann et al. | |
| 2011/0203619 | A1 | 8/2011 | Kara et al. | |
| 2013/0125936 | A1 * | 5/2013 | Forster | A47L 15/18 134/198 |
| 2013/0206179 | A1 | 8/2013 | Watson et al. | |
| 2014/0102492 | A1 * | 4/2014 | Kim | A47L 15/23 134/172 |
| 2015/0020855 | A1 | 1/2015 | Lundberg et al. | |
| 2016/0015241 | A1 | 1/2016 | Han et al. | |
| 2016/0220090 | A1 * | 8/2016 | Woo | A47L 15/22 |
| 2016/0220092 | A1 * | 8/2016 | Woo | A47L 15/4282 |
| 2017/0354311 | A1 * | 12/2017 | Yoo | A47L 15/23 |
| 2017/0354312 | A1 * | 12/2017 | Woo | A47L 15/4282 |
| 2018/0271348 | A1 * | 9/2018 | Li | A47L 15/22 |

FOREIGN PATENT DOCUMENTS

| | | | |
|---|---|---|---|
| CH | 564937 | A | 8/1975 |
| CN | 201312795 | Y | 9/2009 |
| CN | 201333016 | Y | 10/2009 |
| CN | 101677743 | A | 3/2010 |
| CN | 102469907 | A | 5/2012 |
| CN | 203789866 | U | 8/2014 |
| CN | 205268092 | U | 6/2016 |
| DE | 7122831 | U | 9/1971 |
| DE | 3428439 | A1 | 2/1986 |
| DE | 9114093 | U1 | 4/1993 |
| DE | 20014038 | U1 | 1/2001 |
| DE | 20113227 | U1 | 11/2001 |
| DE | 10 2011088494 | A1 | 6/2013 |
| DE | 102015207588 | A1 | 10/2016 |
| EP | 0 335 791 | A1 | 10/1989 |
| EP | 772994 | A1 | 5/1997 |
| EP | 2 215 952 | A1 | 8/2010 |
| EP | 2 389 851 | A1 | 11/2011 |
| EP | 2446799 | A2 | 5/2012 |
| EP | 2 721 989 | A1 | 4/2014 |
| EP | 3 050 480 | A1 | 8/2016 |
| GB | 1 462 398 | A | 1/1977 |
| JP | 2006 095001 | A | 4/2006 |
| JP | 2011224232 | A1 | 11/2011 |
| JP | 2014 004270 | A | 1/2014 |
| KR | 102012022429 | A | 3/2012 |
| KR | 102012078276 | A | 7/2012 |
| WO | WO 2011 147716 | A1 | 12/2011 |
| WO | WO 2019/086107 | A1 | 5/2019 |

OTHER PUBLICATIONS

International Search Report and Written Opinion for Application No. PCT/EP2017/077875 dated Jan. 11, 2018, 10 pages.
International Search Report and Written Opinion for Application No. PCT/EP2016/066288 dated Aug. 25, 2016, 9 pages.
Chinese Office Action for Chinese Application No. 201680087436.6, dated Jun. 25, 2021, 8 pages.

* cited by examiner

WASH ARM ASSEMBLY

CROSS-REFERENCE TO RELATED APPLICATIONS

This application is a national stage application filed under 35 U.S.C. § 371 of International Application No. PCT/EP2016/066288 filed Jul. 8, 2016, which application is hereby incorporated by reference herein in its entirety.

TECHNICAL FIELD

Embodiments herein relate to a wash arm assembly for a dishwasher.

BACKGROUND

Today's dishwashers are expected to perform high quality wash of dishware while at the same time to efficiently use of water and energy in order to fulfill requirements concerning environmental impact and sustainability. Various arrangements, taking up some space within the dishwasher, for washing of the dishware in an efficient manner have thus been developed. However, it is also desired that the dishwashers can accommodate a lot of dishware to be washed. Therefore, it is desired that space within the dishwashers for accommodating dishware is as large as possible. A trade-off between space for dishware and environmental impact is consequently made.

A known dishwasher comprises a so called upper wash arm connection as one typical example of the aforementioned arrangements for washing of dishware. The upper wash arm connection connects an upper central wash arm to a tube for providing washing liquid to be exerted out of the upper central wash arm. It is thus desired that the upper wash arm connection has a low profile to limit space occupied by it within the dishwasher. Furthermore, leakage of the washing liquid through the connection is desired to be limited. The upper wash arm connection should also be characterized by low friction, low sensitivity to dirt and high abrasive resistance.

Furthermore, the known dishwasher can comprise a satellite wash arm, connected to the central wash arm by means of a bearing. The bearing includes a tubular connection portion of the satellite wash arm inserted in a tubular receiving portion of the central wash arm. The bearing allows the satellite wash arm to rotate in relation to the central wash arm. During operation of the dishwasher, when the washing liquid is delivered to the satellite wash arm through the central wash arm, the washing liquid causes the satellite wash arm to lift from the bearing. Usually, there is a locking means limiting a distance the satellite wash arm may lift. The lift of the satellite wash arm results in leakage of washing liquid between the tubular connection and tubular receiving portions. The leakage lubricates the bearing, whereby friction between the tubular connection and tubular receiving portions is reduced.

One problem with known wash arm assemblies, such as the wash arm connection, the bearing and the like, is that a wash arm, such as the satellite wash arm or the central wash arm, may wobble when, for example dirt get stuck in the wash arm assembly if the wash arm lifts too much during operation of the dishwasher. Wobbling causes more leakage and larger losses due to increased friction. The wobbling may also cause the wash arm to hit some part of the dishwasher or dishware accommodated in the dishwasher.

SUMMARY

An object of the embodiments herein is to provide a wash arm assembly for a dishwasher comprising a wash arm, which the wash arm assembly provides an improved rotational movement of the wash arm.

According to an aspect of the present disclosure, the object is achieved by a wash arm assembly for a dishwasher. The wash assembly comprises a wash arm, comprising a tubular connection portion and a tubular receiving means for receiving the tubular connection portion. The tubular connection portion is arranged to be inserted in the tubular receiving means to create a connection between the tubular connection portion and the tubular receiving means. Thus, the tubular connection portion may be easily connected to the tubular receiving means by inserting the tubular connection portion in the tubular receiving means. Further, the tubular connection portion and the tubular receiving means may be easily disconnected by pulling out the tubular connection portion from the tubular receiving means.

The connection allows the wash arm to rotate, which means that the tubular connection portion of the wash arm may rotate in relation to the tubular receiving means when the tubular connection portion has been inserted in the tubular receiving means. Further, the connection is arranged to conduct a washing liquid of the dishwasher in a first direction to the wash arm. Thus, the washing liquid may be supplied to the wash arm through the connection in the first direction.

The tubular connection portion comprises a first guiding surface and a second guiding surface, and the tubular receiving means comprises a third guiding surface and a fourth guiding surface, wherein the first guiding surface is aligned to the third guiding surface and the second guiding surface is aligned to the fourth guiding surface when the tubular connection portion is inserted in the tubular receiving means. As an effect thereof, the tubular insertion portion is guided into a predetermined position in relation to the tubular receiving means when the tubular insertion portion is inserted into the tubular receiving means. In other words, the first, second, third and fourth guiding surfaces are arranged to lead, or guide, the tubular insertion portion to the predetermined position in relation to the tubular receiving means when the tubular insertion portion is inserted into the tubular receiving means. Said predetermined position of the tubular insertion portion in relation to the tubular receiving means is a position, in which an essentially unhindered, or non-inhibited, rotation of the tubular insertion portion within the tubular receiving means. In such a position, the first guiding surface and the third guiding surface as well as the second guiding surface and the fourth guiding surface are at least substantially parallel to each other. To sum up, thanks to the first, second, third and fourth guiding surfaces, the tubular insertion portion may easily be positioned in the tubular insertion means in said predetermined position to achieve an improved rotational movement for the wash arm. Further, the predetermined position may be achieved repeatedly each time the tubular insertion portion is inserted in the tubular receiving means thanks to the guiding surfaces of the tubular insertion portion and the tubular receiving means.

The first, second, third and fourth guiding surfaces are arranged to guide the tubular connection portion and the tubular receiving means into alignment with each other upon rotation of the wash arm. The tubular connection portion is tapered in the first direction along the first guiding surface, and wherein the tubular connection portion is tapered in a second direction, being opposite to the first direction, along the second guiding surface. The tubular receiving means is tapered in the first direction along the third guiding surface and wherein the tubular receiving means is tapered in the second direction along the fourth guiding surface.

Since the first, second, third and fourth guiding surfaces are arranged to guide the tubular connection portion and the tubular receiving means into alignment with each other upon rotation of the wash arm, the tubular connection portion and the tubular receiving means are guided to a position where the first, second, third and fourth guiding surfaces align with each other upon rotation of the wash arm. In such a position the first, second, third and fourth guiding surfaces are at least substantially parallel with each other. Thereby, during rotation of the wash arm, the first, second, third and fourth guiding surfaces are all the time guided into alignment with each other even if the first, second, third and fourth guiding surfaces are not pairwise completely parallel to each other at all times as explained in more detail below.

A disturbance of the wash arm, effecting the rotational movement of the wash arm, may lead to wobbling of the wash arm. During the wobbling, the first, second, third and fourth guiding surfaces are displaced from alignment with each other. However, on account of that the tubular connection portion is tapered in the first direction along the first guiding surface and that the tubular receiving means is tapered in the first direction along the third guiding surface, the tubular connection portion is guided back to the position where the first and third guiding surfaces align with each other. Additionally, on account of that the tubular connection portion is tapered in a second direction along the second guiding surface and that the tubular receiving means is tapered in the second direction along the fourth guiding surface, the tubular connection portion is guided back to the position where the second and fourth guiding surfaces align with each other.

To sum up, when a disturbance of the wash arm occurs the tubular insertion portion is guided back, e.g. brought back, to a position where the first, second, third and fourth guiding surfaces align with each other upon rotation of the wash arm. This occurs thanks to friction forces, acting on the tubular connection portion and creating a momentum that with Coriolis forces strives to straighten the wash arm's position during rotation of the wash arm. The forces and the momentum are created because the tubular connection portion and the tubular receiving means are tapered along the first, second, third and fourth guiding surfaces as described above. Thereby, wobbling of the wash arm is prevented.

As an effect, the improved rotational movement of the wash arm is achieved.

Consequently, an improved wash arm assembly is obtained.

As a result, the above mentioned object is achieved.

In some embodiments, the tubular connection portion comprises an upstream edge and a downstream edge in relation to a stream of washing liquid in the first direction, wherein the first guiding surface is arranged at the upstream edge and the second guiding surface is arranged at the downstream edge.

The wash arm assembly may comprise a main wash arm of the dishwasher, wherein the wash arm is connectable to the main wash arm by means of the connection, wherein the main wash arm comprises the tubular receiving means. Thereby, the wash arm may be attached to the main wash arm. The wash arm thus acts as a so called satellite wash arm. Accordingly, an improved wash arm assembly for assembling the satellite wash arm onto the main wash arm is achieved.

In some embodiments, the tubular receiving means is connectable to a conduit arranged to convey the washing liquid to an interior of the dishwasher. Thereby, the wash arm may be attached to a tube for supplying the washing liquid to the dishwasher.

The first guiding surface is defined by a first envelope surface of a first cut-off cone pointing in the first direction.

The second guiding surface is defined by a second envelope surface of a second cut-off cone pointing in the second direction.

According to another aspect of the embodiments herein, the object is achieved by a dishwasher comprising a wash arm assembly according to the embodiments herein.

Further features of, and advantages with, the embodiments herein will become apparent when studying the appended claims and the following detailed description. Those skilled in the art will realize that the different features described may be combined to create embodiments other than those described in the following, without departing from the scope of the embodiments herein, as defined by the appended claims.

BRIEF DESCRIPTION OF THE DRAWINGS

The various aspects of the embodiments herein, including its particular features and advantages, will be readily understood from the following detailed description and the accompanying drawings, in which.

DETAILED DESCRIPTION

The embodiments herein will now be described more fully with reference to the accompanying drawings, in which example embodiments are shown. Disclosed features of example embodiments may be combined. Like numbers refer to like elements throughout. Well-known functions or constructions will not necessarily be described in detail for brevity and/or clarity.

Figure 1:
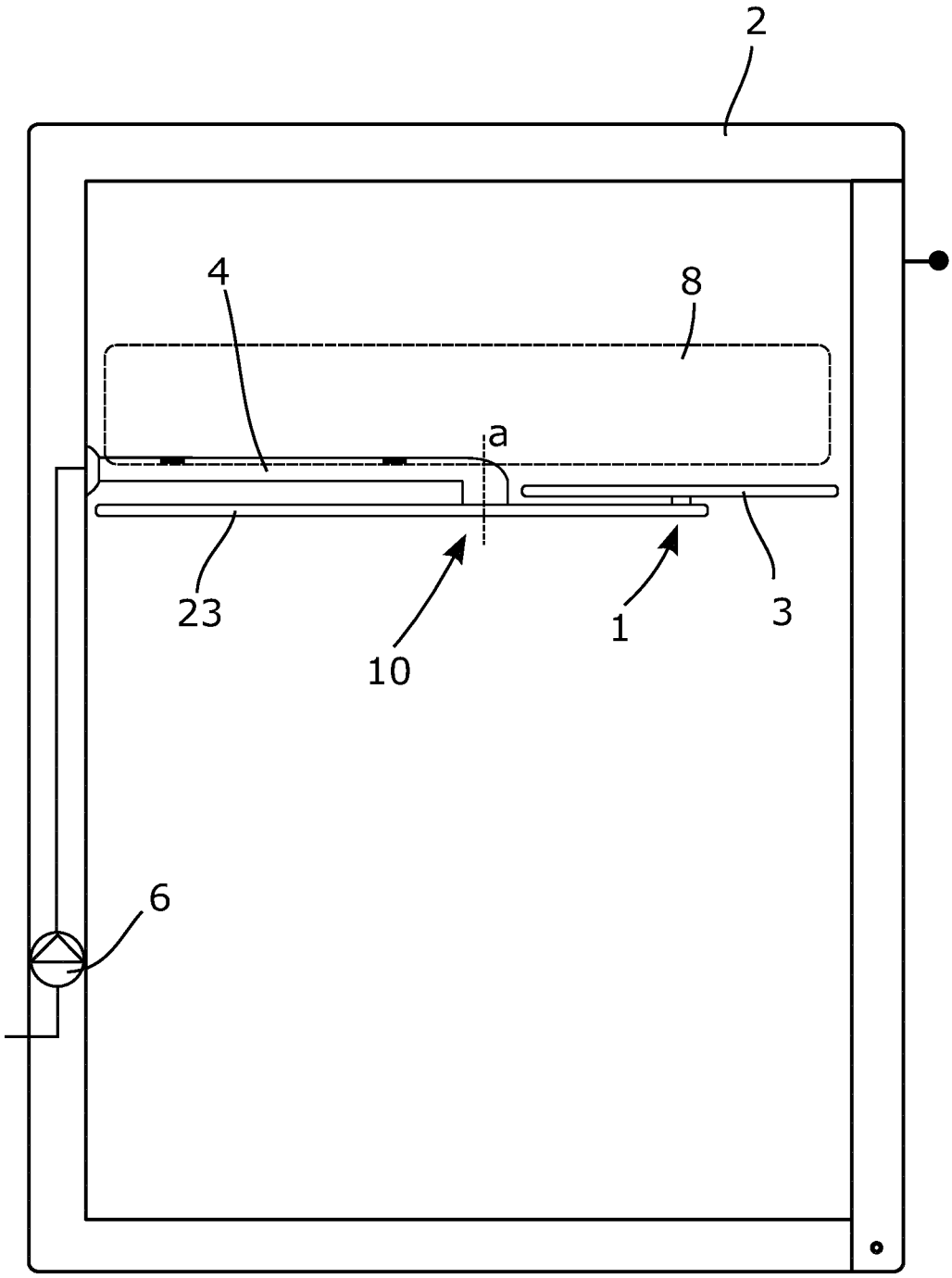
FIG. 1 is a perspective view illustrating a dishwasher comprising a wash arm assembly.

FIG. 1 illustrates a wash arm assembly 1 arranged within an interior of a dishwasher 2. The dishwasher 2 may thus be said to comprise the wash arm assembly 1. The dishwasher 2 comprises a wash arm 3 and main wash arm 23. The wash arm 3 is sometimes referred to as a satellite wash arm in relation to the main wash arm 23. As shown in FIG. 1 the main wash arm 23 is rotatably connected to a main tube 4, through which a washing liquid is supplied to the wash arm assembly 1. The main wash arm 23 is arranged to rotate around an axis a. Typically, the main tube 4 is connected to a washing liquid supply line comprising a pump 6 for supplying of the washing liquid to the dishwasher 2. According to the embodiment illustrated in FIG. 1, the wash arm assembly 1 is arranged under a basket 8 for accommodating dishware (not shown) to be washed within the dishwasher 2. In such a position within the dishwasher 2, the wash arm assembly 1 may also be referred to as an upper wash arm assembly. It means that the wash arm assembly is arranged at an upper position within the interior of the dishwasher 2. The upper position shall be understood as "upper" in relation to an ordinary operation of the dishwasher 2. Furthermore, FIG. 1 shows a further wash arm assembly 10. The embodiments herein may be applied to the wash arm assembly 1 and/or the further wash arm assembly 10. For simplicity, it is in the following referred to the wash arm assembly 1 only.

Figure 2:
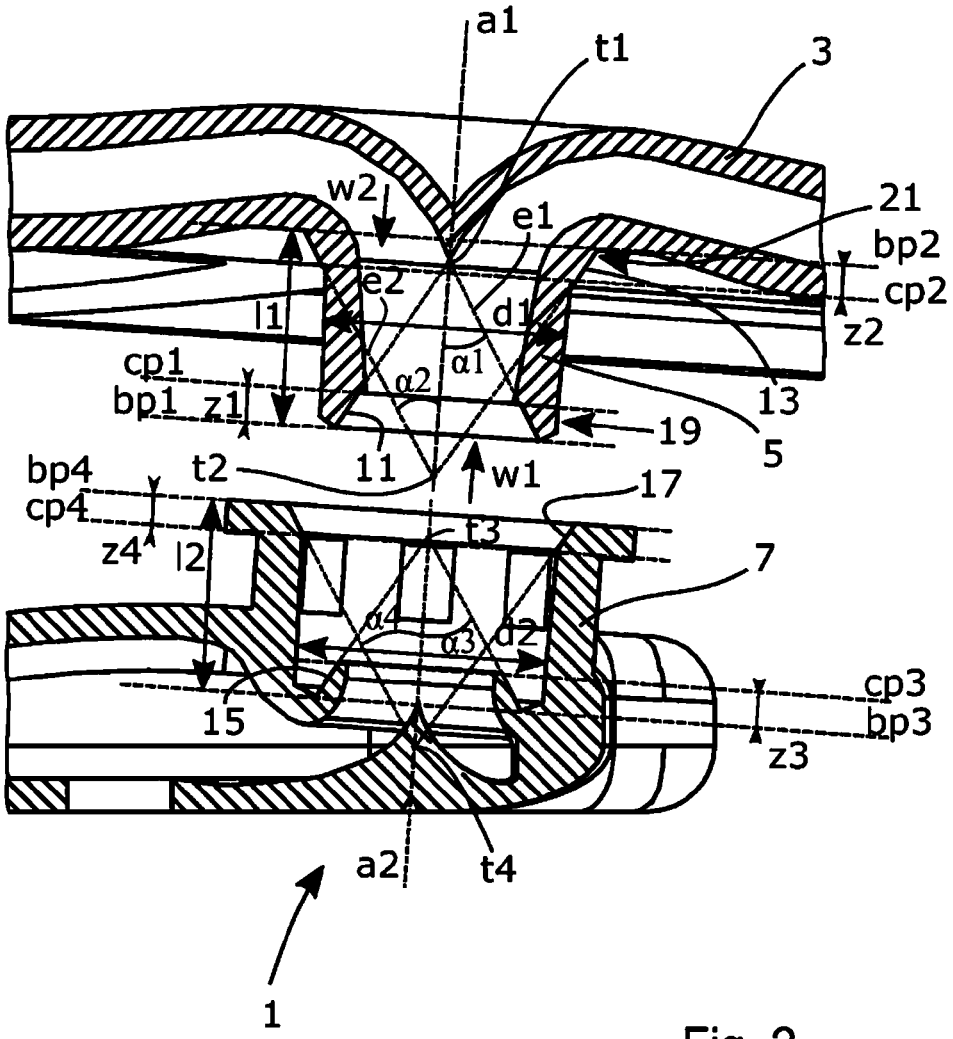
FIG. 2 is a plan view illustrating the wash arm assembly illustrated in FIG. 1, wherein the wash arm assembly is disassembled.

FIG. 2 illustrates a more detailed side-view of the wash arm assembly 1 shown in FIG. 1. The wash arm assembly 1 is arranged for assembling a wash arm 3 of a dishwasher. In other words the wash arm assembly 1 is arranged for mounting of the wash arm 3 within the dishwasher.

The wash arm assembly 1 comprises the wash arm 3 and a tubular receiving means 7, such as a tubular element, pipe piece or the like. Further, the wash arm 3 comprises a tubular connection portion 5, such as tubular element, pipe piece or the like, arranged to be inserted in the tubular receiving means 7 to create a connection 9 (shown in FIG. 3) between the tubular connection portion 5 and the tubular receiving means 7. The FIG. 2 illustrates a detailed side-view of the wash arm assembly 1 with focus on the tubular connection portion 5 and the tubular receiving means 7. In some embodiments herein, the tubular connection portion 5 is arranged as an integrated part of the wash arm 3. The connection portion 5 may also be arranged as a separate member that may be connected to the wash arm 3.

The connection 9 according to the embodiments herein may also be called for hydraulic ejector connection because of the form of channels for delivering the washing liquid to the wash arm 3. Hydraulic ejector connections are well known in the art and therefore not described in details herein.

The tubular connection portion 5 and the tubular receiving means 7 are formed as tubes, i.e. shaped as circular pipes, wherein the tubular connection portion 5 has a first diameter d1 and a length l1 and the tubular receiving means 7 has a second diameter d2 and a depth l2. The first diameter d1 indicates an outer diameter of the tubular connection portion 5. The second diameter d2 indicates an inner diameter of the tubular receiving means 7. The first diameter d1 is less than the second diameter d2 to enable insertion of the tubular connection portion 5 into the tubular receiving means 7.

Clearance between the first diameter d1 and the second diameter d2 may be in a range of 1-3 mm.

The tubular connection portion 5 comprises a first guiding surface 11 and a second guiding surface 13, and the tubular receiving means 7 comprises a third guiding surface 15 and a fourth guiding surface 17. The length l1 of the tubular connection portion 5 and the depth l2 of the tubular receiving means 7 are determined to achieve an alignment of the first guiding surface 11 with the third guiding surface 15 and the second guiding surface 13 with the fourth guiding surface 17 when the tubular connection portion 5 is inserted into the tubular receiving means 7. Further, the length l1 of the tubular connection portion 5 is determined in order to place the first guiding surface 11 below a center of gravity (not shown) of the wash arm 3. For example, the first guiding surface 11 may be arranged 20 mm below the center of gravity of the wash arm 3.

According to some embodiments herein, the tubular receiving means 7 is arranged at the main wash arm 23, sometimes also referred to as a central wash arm. As illustrated in FIG. 1, the tubular receiving means 7 may be arranged at a peripheral portion of the main wash arm 23 in relation to a main axis al around which the main wash arm 23 is rotatable. Then, the wash arm 3 may be connected to the main wash arm 23 at said peripheral portion of the main wash arm 23.

In some embodiments, the tubular receiving means 7 is connectable to a conduit arranged to convey the washing liquid to an interior of the dishwasher. Thus, the tubular receiving means 7 may be arranged at a tube (not shown) for supply the washing liquid to the dishwasher. In such an embodiment, the wash arm 3 is directly connected to the tube.

The tubular receiving means 7 may be arranged as a separate member arranged to be fastened to the main wash arm 23 or to the tube. According to some embodiments herein, the tubular receiving means 7 is arranged as a part of the main wash arm 23.

As illustrated in FIG. 2, the tubular connection portion 5 comprises the first guiding surface 11 and the second guiding surface 13, and the tubular receiving means 7 comprises the third guiding surface 15 and the fourth guiding surface 17. Thereby, the tubular insertion portion 5 is guided, or in other words led or positioned by the first, second, third and fourth guiding surfaces 11, 13, 15, 17 in a predetermined position in relation to the tubular receiving means 7 when the tubular insertion portion 5 is inserted in the tubular receiving means 7.

According to the embodiments herein he tubular connection portion 5 is tapered in a first direction w1 along the first guiding surface 11 constituting a part of an internal surface of the tubular connection portion 5. The direction w1 is a direction the washing liquid is delivered to the wash arm 3 through the tubular connection portion 5 of the wash arm 3. The tubular connection portion 5 is also tapered in a second direction w2, being opposite to the first direction w1, along the second guiding surface 13 constituting a part of an external surface the tubular connection portion 5. Internal and external relate to a common meaning of what is meant with interior and exterior of a tube for delivering a liquid. Consequently, interior means where the liquid flows in the tube.

In a similar way, the tubular receiving means 7 is tapered in the first direction w1 along the third guiding surface 15 and is tapered in the second direction w2 along the fourth guiding surface 17. Both the third guiding surface 15 and the fourth guiding surface 17 constitute a part of an internal surface of the tubular receiving portion 7.

As illustrated in FIG. 2, the tubular connection portion 5 comprises an upstream edge 19 and a downstream edge 21 in relation to a stream of washing liquid in the first direction w1, wherein the first guiding surface 11 is arranged at the upstream edge 19 and the second guiding surface 13 is arranged at the downstream edge 21.

The first, second, third and fourth guiding surfaces 11, 13, 15, and 17 are arranged so the first guiding surface 11 is aligned to the third guiding surface 15 and the second guiding surface 13 is aligned to the fourth guiding surface 17 when the tubular connection portion 5 is inserted in the tubular receiving means 7. With aligned is meant that the first, and third guiding surfaces 11, 15 respectively the second and fourth guiding surfaces 13, 17 are substantially parallel to each other and may have a contact with each other or there may be a distance between the surface 11, 15 when the connection portion 5 is inserted in the receiving means 7.

Before the washing liquid is delivered to the wash arm 3, the first, second, third and fourth guiding surfaces 11, 13, 15, and 17 may abut against, or have contact with or touch, each other as described above when the tubular connection portion 5 is inserted in the tubular receiving means 7. When the washing liquid is supplied to the wash arm 3, lift forces are created in the wash arm 3. The lift forces may lift the wash arm 3 if the pressure is enough to overcome all forces, for example gravitational forces or forces from spray nozzles (not shown) of the wash arm 3, acting on the wash arm 3 in the second direction w2, opposite to the first direction w1 of delivering the washing liquid. When the wash arm 3 lifts the first guiding surface 11 and the third guiding surface 15 respectively the second guiding surface 13 and the fourth guiding surface 17 are separated from each other. Thus, allowing washing liquid to lubricate the connection 9 in FIG. 3.

The washing liquid has a primary purpose of washing dishware accommodated in the dishwasher. The washing liquid delivered to the wash arm 3 also has a secondary purpose of driving the wash arm 3 during the rotational movement. The wash arm 3 comprises one or several driving nozzles (not shown) arranged at a periphery of the wash arm 3.

The first, second, third and fourth guiding surfaces 11, 13, 15, 17 are arranged to guide the tubular connection portion 5 and the tubular receiving means 7 into alignment with each other upon rotation of the wash arm 3. During rotation of the wash arm 3 the first guiding surface 11 cooperates with the third guiding surface 15 and the second guiding surface cooperates with the fourth guiding surface 17 to guide the tubular connection portion 5 and the tubular receiving means 7 into alignment with each other.

The tubular connection portion 5, and along with it also the wash arm 3, and the tubular receiving means 7 are guided into alignment with each other upon rotation of the wash arm 3 thanks to the first, second, third and fourth guiding surfaces 11, 13, 15, 17 that are defined by envelope surfaces of cut-off cones as described below.

The first guiding surface 11 is defined by a first envelope surface of a first cut-off cone pointing in the first direction w1. The first cut-off cone is cut-off from a first main cone with a first virtual top t1, or a first virtual peak, that may be located on a rotational axis a1 of the wash arm 3. As shown in FIG. 2, the cut-off is done by a first cutting plane cp1 vertically orientated to the rotational axis a1 at a first distance z1 from a first base plane bp1 of the first main cone with the first virtual top t1. The first distance z1 may, for example be 3 mm.

A location of said first virtual top t1 relatively the first base plane bp1 determines a first inclination of said first main cone. The first inclination may be defined by a first angle $\alpha 1$ between the rotational axis a1 and a first line e1 on the envelope surface of the first main with said first virtual top t1. The greater distance of the first virtual top t1 from the first base plane bp1 results in the greater first inclination of the first main cone i.e. the less the first angle $\alpha 1$. The first angle $\alpha 1$ may be in a range of 25-35 degrees.

The second guiding surface 13 is defined by a second envelope surface of a second cut-off cone pointing in the second direction w2. The second cut-off cone is cut-off from a second main cone with a second virtual top t2 that also may be located on the rotational axis a1. As shown in FIG. 2, the cut-off is done by a second cutting plane cp2 vertically orientated in relation to the rotational axis a1 of the wash arm 3 at a second distance z2 from a second base plane bp2 of the second main cone with the second virtual top t2. The second distance z2 may, for example be 3 mm.

Similarly to the first virtual top t1, a location of said second virtual top t2 relatively the second base plane bp2 defines a second inclination of said second main cone with the second virtual top t2. The second inclination may be defined by a second angle $\alpha 2$ between the rotational axis a1 and a second line e2 on the envelope surface of the second main cone with said second virtual top t2.The greater distance of the second virtual top t2 from the second base plane bp2 results in the greater second inclination of the second main cone i.e. the less the second angle $\alpha 2$. The second angle $\alpha 2$ may be in a range of 30-45 degrees.

Said third and fourth guiding surfaces 15, 17 of the tubular receiving means 7 are arranged in similar way to the first and second guiding surfaces 11, 13 of the tubular connection portion 5 described above. However, the third and fourth guiding surfaces 15, 17 are arranged in relation to a second axis a2 through a center of the tubular receiving means 7.

The third guiding surface 15 is defined by a third envelope surface of a third cut-off cone pointing in the first direction w1. The third cut-off cone is cut-off from a third main cone with a third virtual top t3 that may be located on the second axis a2. As shown in FIG. 2, the cut-off is done by a third cutting plane cp3 vertically orientated to the second axis a2 of the tubular receiving means 7 at a third distance z3 from a third base plane bp3 of the third main cone with the third virtual top t3. The third distance z3 may be equal or greater than the first distance z1. The third main cone with the third virtual top t3 has an inclination defined by a third angle $\alpha 3$. According to some embodiments herein the third angle $\alpha 3$ is substantially equal said first angle $\alpha 1$.

Further, the fourth guiding surface 17 is defined by a fourth envelope surface of a fourth cut-off cone pointing in the second direction w2. The fourth cut-off cone is cut-off from a fourth main cone with a fourth virtual top t4 that may be located on the axis a2. As shown in FIG. 2, the cut-off is done by a fourth cutting plane cp4 vertically orientated to the axis a2 of the tubular receiving means 7 at a fourth distance z4 from a fourth base plane bp4 of the fourth main cone with the fourth virtual top t4. The fourth distance z4 may be equal or less than the second distance z2. The fourth main cone with the fourth virtual top t4 has an inclination defined by a fourth angle $\alpha 4$. According to some embodiments herein the fourth angle $\alpha 4$ is substantially equal said second angle $\alpha 2$.

Consequently, when a disturbance of the wash arm 3 occurs the tubular insertion 5 portion is guided back, e.g. brought back, to a position where the first, second, third and fourth guiding surfaces 11, 13, 15 and 17 align with each other upon rotation of the wash arm 3, thanks to that the tubular connection portion 5 and the tubular receiving means 7 are tapered along the first, second, third and fourth guiding surfaces 11, 13, 15 and 17 as described above.

As an effect, the improved rotational movement of the wash arm is achieved and thereby an improved wash arm assembly is obtained.

Figure 3:
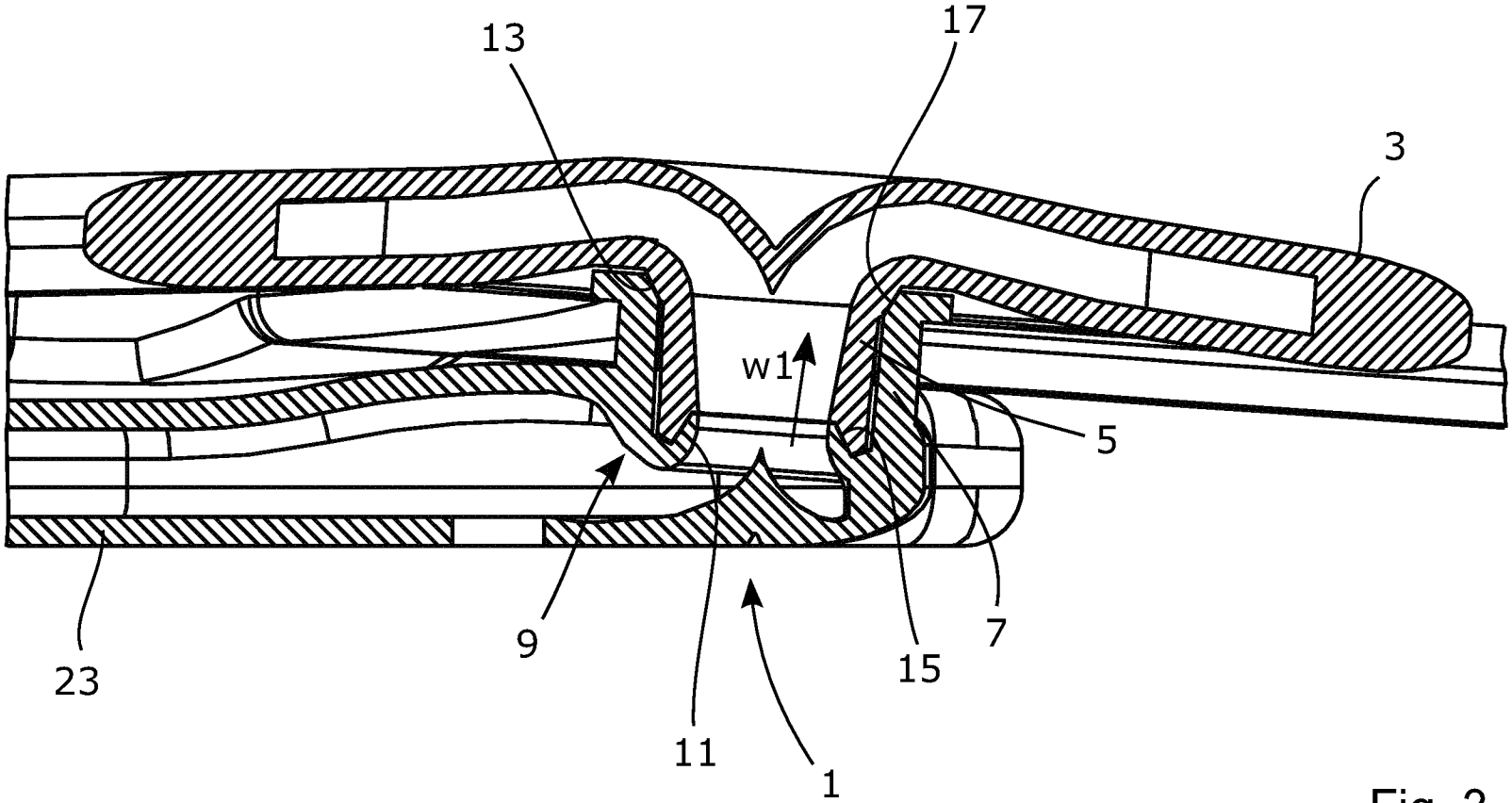
FIG. 3 is another plan view illustrating the wash arm assembly illustrated in FIG. 1, wherein the wash arm assembly is assembled.

FIG. 3 shows the wash arm assembly 1 illustrated in FIG. 1 and FIG. 2. In FIG. 3, a larger portion of the wash arm 3 and a larger portion of the main wash arm 23 are visible compared to FIG. 2. The tubular connection portion 5 is inserted into the tubular receiving means 7 to create said connection 9 described above. As described above, the tubular connection portion 5 comprises the first guiding surface 11 and the second guiding surface 13, and the tubular receiving means 7 comprises the third guiding surface 15 and the fourth guiding surface 17. According to FIG. 3 the first guiding surface 11 is aligned to the third guiding surface 15 and the second guiding surface 13 is aligned to the fourth guiding surface 17 i.e. the first, second, third and fourth guiding surfaces 11, 13, 15 and 17 are parallely orientated and in contact with each other when tubular connection portion 5 is inserted in the tubular receiving means 7. The first, and third guiding surfaces 11, 15 as well as the second and fourth guiding surfaces 13, 17 are in contact with each other before pressure of a washing liquid, supplied to the wash arm 3, causes the wash arm 3 to be displaced in a direction w1. Accordingly, FIG. 3 illustrates the wash arm assembly 1 in before the wash arm 3 has lifted from the tubular receiving means 7.

The invention claimed is:

1. A wash arm assembly for a dishwasher, comprising:

a wash arm comprising a tubular connection portion; and a tubular receiving means for receiving said tubular connection portion, wherein said tubular connection portion is arranged to be inserted in said tubular receiving means to create a connection between said tubular connection portion and said tubular receiving means, wherein the connection allows the wash arm to rotate and wherein said connection is arranged to conduct a washing liquid of the dishwasher in a first direction to said wash arm, wherein said tubular connection portion comprises an upstream annular edge and a second guiding surface, the upstream annular edge comprising a first guiding surface, and said tubular receiving means comprises an inwardly extending annular channel comprising a third guiding surface therein and a downstream end defining a fourth guiding surface, wherein the upstream annular edge is received into the inwardly extending annular channel when said tubular connection portion is inserted in said tubular receiving means, wherein the upstream annular edge of the tubular connection portion is configured to be disposed upstream of the downstream end of the tubular receiving means relative to the washing liquid flowing in the first direction when said tubular connection portion is inserted in said tubular receiving means during operation, wherein said first guiding surface is aligned to said third guiding surface and said second guiding surface is aligned to said fourth guiding surface when said tubular connection portion is inserted in said tubular receiving means, wherein in an instance in which tubular connection portion is inserted in said tubular receiving means, said first guiding surface is in contact with said third guiding surface while said second guiding surface is in contact with said fourth guiding surface, wherein said first guiding surface and said third guiding surface are arranged to cooperate to guide said tubular connection portion and said tubular receiving means into alignment with each other upon rotation of the wash arm, wherein said second guiding surface and said fourth guiding surface are arranged to cooperate to guide said tubular connection portion and said tubular receiving means into alignment with each other upon rotation of the wash arm, wherein said tubular connection portion is tapered in said first direction along said first guiding surface, wherein said tubular connection portion is tapered in a second direction, being opposite to said first direction, along said second guiding surface, wherein said tubular receiving means is tapered in said first direction along said third guiding surface, and wherein said tubular receiving means is tapered in said second direction along said fourth guiding surface.

2. The wash arm assembly according to claim 1, wherein said tubular connection portion comprises the upstream annular edge and a downstream edge in relation to a stream of washing liquid in said first direction, wherein said first guiding surface is arranged at said upstream annular edge and said second guiding surface is arranged at said downstream edge.

3. The wash arm assembly according to claim 1, wherein the first guiding surface is defined by a first envelope surface of a first cut-off cone pointing in said first direction.

4. The wash arm assembly according to claim 1, wherein the second guiding surface is defined by a second envelope surface of a second cut-off cone pointing in said second direction.

5. A dishwasher comprising the wash arm assembly according to claim 1.

6. The dishwasher according to claim 5, comprising a main wash arm of the dishwasher, wherein said wash arm is connectable to said main wash arm by means of said connection, wherein said main arm comprises said tubular receiving means.

7. The dishwasher according to claim 5, wherein said tubular receiving means is connectable to a conduit arranged to convey the washing liquid to an interior of the dishwasher.

8. The wash arm assembly according to claim 1, wherein said first guiding surface is defined on an at least partially inwardly-facing side of the tubular connection portion and said second guiding surface is defined on an at least partially outwardly-facing side of the tubular connection portion.

9. The wash arm assembly according to claim 1, wherein said first guiding surface and said second guiding surface are defined on opposite ends of the tubular connection portion relative to the first direction along the tubular connection portion.

10. The wash arm assembly according to claim 1, wherein in an instance in which tubular connection portion is inserted in said tubular receiving means, said first guiding surface is parallel to said third guiding surface and said second guiding surface is parallel to said fourth guiding surface.

11. The wash arm assembly according to claim 10, wherein in an instance in which tubular connection portion is inserted in said tubular receiving means, said first guiding surface is in contact with said third guiding surface and said second guiding surface is in contact with said fourth guiding surface.

12. The wash arm assembly according to claim 1, wherein in operation, said tubular connection portion is configured to contact and guide washing liquid via an interior surface of the tubular connection portion.

13. The wash arm assembly according to claim 1, wherein said tubular connection portion defines an axis extending along said first direction and said second direction, wherein said first guiding surface is disposed radially inward of said second guiding surface relative to the axis.

14. The wash arm assembly according to claim 13, wherein the tubular receiving means defines an axis extending along said first direction and said second direction, wherein the third guiding surface is disposed radially inward of the fourth guiding surface relative to the axis.

15. The wash arm assembly according to claim 1, wherein the first guiding surface of the tubular connection portion is configured to be inserted in said tubular receiving means in an instance in which said first guiding surface is aligned to said third guiding surface when said tubular connection portion is inserted in said tubular receiving means.

16. The wash arm assembly according to claim 15, wherein the second guiding surface of the tubular connection portion is configured to be inserted in said tubular receiving means in an instance in which said second guiding surface is aligned to said fourth guiding surface when said tubular connection portion is inserted in said tubular receiving means.

17. The wash arm assembly according to claim 1, wherein said third guiding surface is configured to apply a first reaction force to said first guiding surface at least partially in the first direction, and wherein said fourth guiding surface is configured to apply a second reaction force to said second guiding surface at least partially in the first direction.

18. The wash arm assembly according to claim 17, wherein the tubular connection portion defines an axis extending along said first direction and said second direction, wherein the first reaction force is at least partially radially inward relative to the axis, and wherein the second reaction force is at least partially radially outward relative to the axis.

* * * * *